US005327811A

United States Patent [19]

Price et al.

[11] Patent Number: 5,327,811

[45] Date of Patent: Jul. 12, 1994

[54] LIGHTWEIGHT BALLISTIC PROTECTIVE DEVICE

[75] Inventors: Allen L. Price, Rising Sun, Md.; Oliver L. North, Bluemont; Joseph F. Fernandez, Vienna, both of Va.

[73] Assignee: Guardian Technologies International, Sterling, Va.

[21] Appl. No.: 691,227

[22] Filed: Apr. 25, 1991

[51] Int. Cl.[5] ..... F41H 1/02

[52] U.S. Cl. ..... 89/36.05; 2/2.5; 428/911

[58] Field of Search ..... 2/2, 2.5, 4, 16, 24, 2/44, 81, 84, 102, 267, 268, 243 A, 243.1; 428/255, 394, 397, 911; 89/36.02, 36.05

[56] References Cited

U.S. PATENT DOCUMENTS

| | | | |
|---|---|---|---|
| 2,466,597 | 4/1949 | Kropscott et al. | 2/2.5 X |
| 2,789,076 | 4/1957 | Friedler et al. | 2/2.5 X |
| 3,841,954 | 10/1974 | Lawler | 89/36.02 |
| 4,079,464 | 3/1978 | Roggin | 428/911 |
| 4,183,097 | 1/1980 | Mellian | 2/2.5 |
| 4,466,135 | 8/1984 | Coppage, Jr. | 2/2.5 |
| 4,472,835 | 9/1984 | Clark | 2/102 |
| 4,483,020 | 11/1984 | Dunn | 2/2.5 |
| 4,485,491 | 12/1984 | Rasmussen | 2/2.5 |
| 4,530,111 | 7/1985 | Barron et al. | 2/2.5 |
| 4,663,231 | 5/1987 | Girgis et al. | 428/394 X |
| 4,879,165 | 11/1989 | Smith | 2/2.5 X |
| 4,989,266 | 2/1991 | Borgese et al. | 2/2.5 |
| 4,993,076 | 2/1991 | Diericky | 2/267 X |
| 4,996,099 | 2/1991 | Cooke et al. | 428/255 X |
| 5,008,959 | 4/1991 | Coppage Jr. et al. | 2/2.5 |
| 5,020,157 | 6/1991 | Dyer | 2/2.5 |
| 5,146,625 | 9/1992 | Steele et al. | 2/102 |
| 5,157,792 | 10/1992 | Allen et al. | 2/2.5 |

FOREIGN PATENT DOCUMENTS

| | | | |
|---|---|---|---|
| 2394055 | 2/1979 | France | 2/2.5 |
| 2124887 | 2/1984 | United Kingdom | 2/2.5 |

*Primary Examiner*—Stephen C. Bentley
*Attorney, Agent, or Firm*—John J. Byrne

[57] ABSTRACT

A body armor vest, the principle components of which are SPECTRA SHIELD packages sandwiched between SPECTRA woven fabric packages, and the combination of the carrier, packages, groin protector and the securing devices contribute a more adaptable vest of increased projectile resistance, reduced weight and improved wearability.

6 Claims, 3 Drawing Sheets

LIGHTWEIGHT BALLISTIC PROTECTIVE DEVICE

FIELD OF THE INVENTION

This invention relates to an improved body armor vest that protects the wearer thereof from projectiles.

BACKGROUND OF THE INVENTION

This invention relates to an improved body armor vest having improved protection against projectiles while at the same time providing increased comfort over armor of the prior art offering similar protection. Protective body armor, made from ballistic textile materials, is known to the prior art. Many workers in this art use aramid fibers sold by Dupont under the trademark KEVLAR.

Another protective body armor formed of ballistic textiles utilizing polyethylene based fibers is sold by the Allied Fibers Division of Allied Signal, Inc. under the trademark SPECTRA. SPECTRA fiber is an ultra high modular weight polyethylene fiber having extraordinary strength and a low specific gravity. In addition to its high strength to weight ratio, SPECTRA fiber exhibits several outstanding properties such as moisture and chemical resistance. The product is severed by special cutting devices so that it can be configured into a wide variety of protective equipment.

Allied Signal markets ballistic SPECTRA fiber in two formats: woven ballistic fabric and non-woven SPECTRA fiber Shield. The SPECTRA fiber Shield product has two layers of fibers bonded with a resin at 0° to 90° orientation. The fibers and resin are packaged between upper and lower polyethylene film layers.

Products such as Spectra Shield have an advantage over woven systems in that the individual fabric fibers are maintained in tension by the resinous packaging material in which they are secured. This causes a projectile to engage more fibers at impact. The resin in which the Spectra fibers are bonded inhibits the projectile from pushing fibers from the projectile's path.

The woven ballistic SPECTRA fiber fabric is available in various styles and deniers which offer protective qualities essential to producing lightweight and pliable body armor. When Spectra fabric and SPRECTRA SHIELD are combined as described herein, increased levels of protection are achieved at reduced weight and bulk yielding greater comfort to the wearer.

SUMMARY OF THE INVENTION

The present invention has as a principal objective to provide a ballistic vest which has the increased protective characteristics of Spectra and obtains improved comfort by using a series of packages that incorporate the SPECTRA SHIELD product with Spectra woven fabric. Workers in the art of human protective armor have a series of quality standards which indicate the ability of vests to meet certain expectant risks or threat levels. The National Institute of Justice has graded certain threat levels or standards that specify protection afforded by certain equipment and express these standards as follows:

NIJ STANDARD 0101.03
BALLISTIC PROTECTION AGAINST

| THREAT | AMMUNITION | MASS | VELOCITY |
|---|---|---|---|
| II-A | .357 Magnum | 10.2 g | 381 m/s |
| | JSP | 158 gr | (1250 ft/s) |
| | 9 mm | 8.0 g | 332 m/s |
| | FMJ | 124 gr | (1090 ft/s) |
| II | .357 Magnum | 10.2 g | 425 m/s |
| | JSP | 158 gr | (1295 ft/s) |
| | 9 mm | 8.0 g | 358 m/s |
| | FMJ | 124 gr | (1175 ft/s) |
| III-A | .44 Magnum | 15.55 G | 426 m/s |
| | Lead SWC Gas Checked | 240 gr | (1400 ft/s) |
| | 9 mm (Submachine Gun) | 8.0 g | 426 m/s |
| | FMJ | 124 gr | (1400 ft/s) |
| III | 7.62 mm (.308 Winchester) | 9.7 g | 838 m/s |
| | FMJ | 150 gr | (2750 ft/s) |

Abbreviations:
FMJ = Full Metal Jacket
JSP = Jacketed Soft Point
SWC = Semi-Wadcutter An important objective of this invention is to provide a series of ballistically resistant material packages which can be used to easily construct a vest appropriate for a specified threat level. For instance, the increased protection demanded for a threat level III-A over a threat level II can be readily obtained by adding packages of SPECTRA SHIELD shield between two outer packages of Spectra fabric.

Another important objective of this invention is to provide a protective armor vest in which SPECTRA fiber woven packages are quilted in a unique manner which add stability to the packaging.

It is another major objective of the present invention to provide body armor inserts to meet NIJ designated threat levels without adverse impact on the weight, flexibility and comfort of the vest, thus encouraging law enforcement wearability.

A still further objective of the invention is to take advantage of the features of SPECTRA fiber woven fabric and combine them with the SPECTRA SHIELD product to provide a body protector with high ballistic attributes while maintaining minimum bulk and lightness of weight.

Another object if the invention is to provide a protective ballistic armor that does not lose its effectiveness when wet and has increased resistance to deterioration and decay.

A still further objective of the invention is to provide body armor that includes natural and/or synthetic material as a carrier and to line this carrier with HYDROFIL nylon to wick prespiration away from the body.

Another objective of the invention is to provide additional protection by a way of a body armor vest having front and back panels that are sufficiently wide and flexible to overlap below the armpits and utilizing increased strapping to maintain this overlap position.

A further objective of the invention is to provide the assembler of the body armor with a plurality of multiply inserts of SPECTRA SHIELD and SPECTRA fiber woven fabric wherein the assembler can alter the level of protection afforded by the body armor by merely adding or subtracting the number of SPECTRA SHIELD units utilized.

Another important objective of this invention is to provide a method of quilting the SPECTRA fiber packages with a unique stitching array that enhances the ballistic qualities of the vest.

A still further objective of the invention is to provide a vest in which the ballistic packages described herein are utilized within a carrier and to provide that carrier with fastening straps which permit the wearer to cause the armor to be firmly fitted against wearer's torso so that the impact of the projectile is dispersed throughout the largest possible area to reduce blunt trauma injury to the wearer.

Another very important objective of this invention is to provide a combination of SPECTRA SHIELD packages and SPECTRA fiber woven fabric packages in a manner as to provide a comfortable vest having high protective quality while maintaining a low specific gravity, virtually no moisture absorbency and at the same time reducing weight, bulk and increasing comfort.

Another important objective of this invention is to provide superior protection and wearability for a vest which can be easily converted from one threat level to another threat level by the addition of SPECTRA fiber Shield packages.

These and other features, objectives and advantages of the invention will be more fully understood when the following description is read while viewing the attached drawings.

A BRIEF DESCRIPTION OF THE DRAWINGS

FIG. 1 is a perspective view of a ballistic resistant vest;

FIG. 1*a* is a perspective of a ballistic insert;

DESCRIPTION OF THE PREFERRED EMBODIMENT

Figure 1:
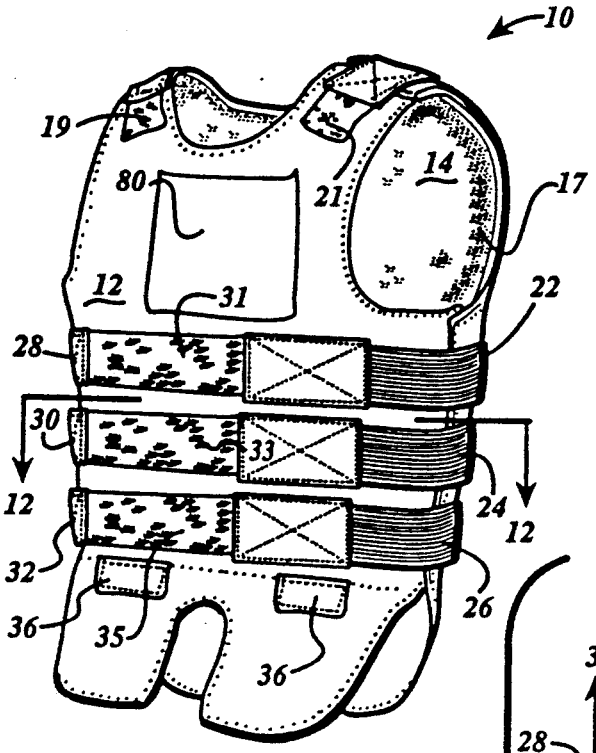
Figure 1A:
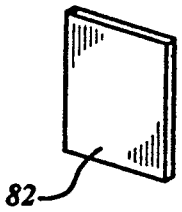
Figure 2:
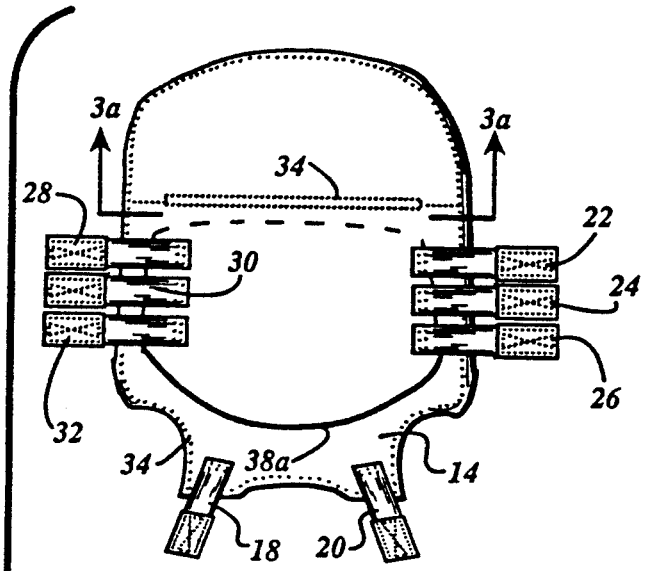
FIG. 2 is a plan view of the vest's principle outer components.
Figure 2:
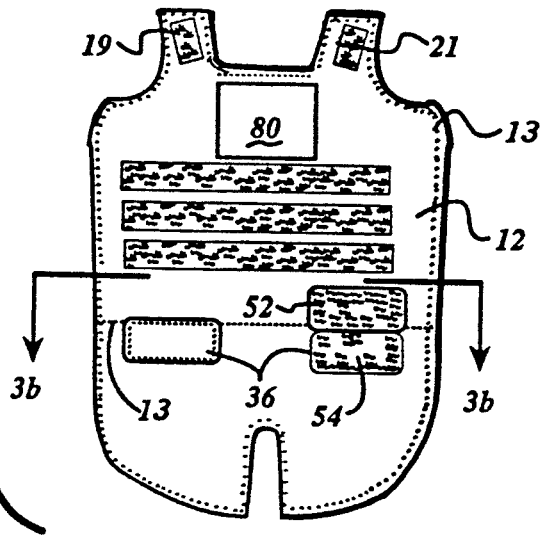
Figure 3:
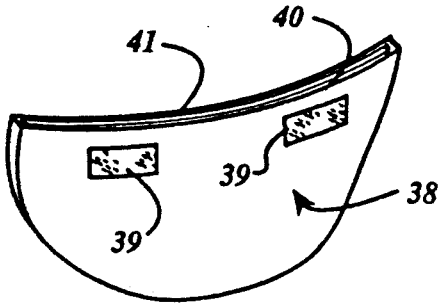
FIG. 3 is a perspective view of a groin protector.

Referring now to the drawings wherein like numerals indicate like parts, the numeral 10 generally indicates the vest of this invention. The vest or garment 10 is comprised of a carrier cover 12 and a rear carrier cover 14. The carrier covers are made of a comfortable cotton or synthetic material without ballistic properties but of sufficient strength to carry the ballistic resistant units. The interior surfaces of the covers 12 and 14 are lined with HYDROFIL nylon 17 to wick moisture from the skin of the wearer. As indicated by dotted line 13, the front carrier cover 12 is formed with a pocket 15 between the front panel and the interior panel of the carrier 12 which receives a ballistic insert 16 of the type shown in FIG. 4. A pair of elastic straps 18 and 20 extend outwardly from the shoulders of the back cover 14. The under surface of straps 18 and 20 are equipped with one element of a non metallic hook and loop fastener (such as VELCRO). The other elements of the hook and loop fastener system are secured to the front carrier at 19 and 21.

Extending laterally outwardly from the carrier 14, are six elastic belts or straps 22, 24, 26, 28, 30 and 32 which are stitched to carrier cover 14. Each elastic strap is equipped with one element of a hook and loop system on their inner surfaces. The other elements of the fastener system are secured to the front cover 12 at areas 31, 33, and 35. It should be noted that the depth or width of the strapping, covers a substantial percentage of the distance between the arm pit openings and the lower edge of the vest.

Figure 4:
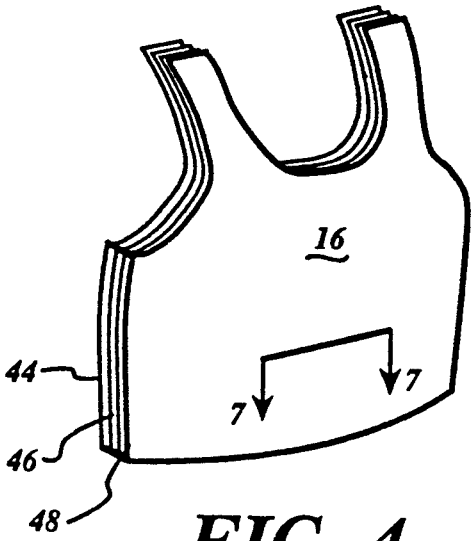
FIG. 4 is a perspective view of a ballistic insert or package of the type that is utilized within the vest shown in FIGS. 1 and 2.
Figure 3A:
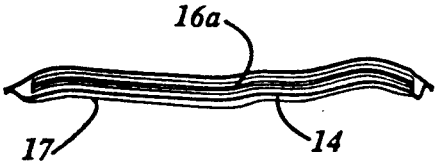
FIG. 3A is a cross section along the line 3A—3A of FIG. 2.
Figure 3B:
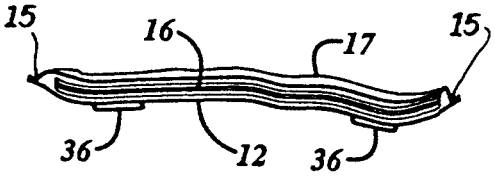
FIG. 3B is a cross section along 3B—3B of FIG. 2.

As seen by the dotted lines shown on the back carrier cover 14, a pocket 34 is formed to receive a ballistic insert also of the type shown in FIG. 4.

Along the bottom edge of front carrier cover 12, a pair of hook and loop pocket-like flaps 36 are secured so that a groin protector 38 can be attached to the front cover. The groin protector consists of a covered ballistic package 41, made of the same SPECTRA fiber ballistic protective materials as FIG. 4. At the upper edge, both on the interior and anterior surfaces, the protector 38 is equipped with a mating fastener elements 39 for securement to hook and loop material beneath flaps 36.

Figure 6:
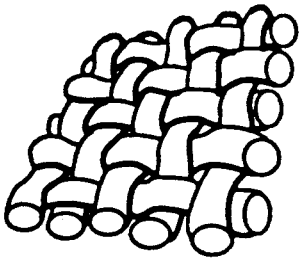
FIG. 6 is a diagrammatic perspective of a single ply of the SPECTRA fiber fibers in the woven ballistic fabric.
Figure 5:
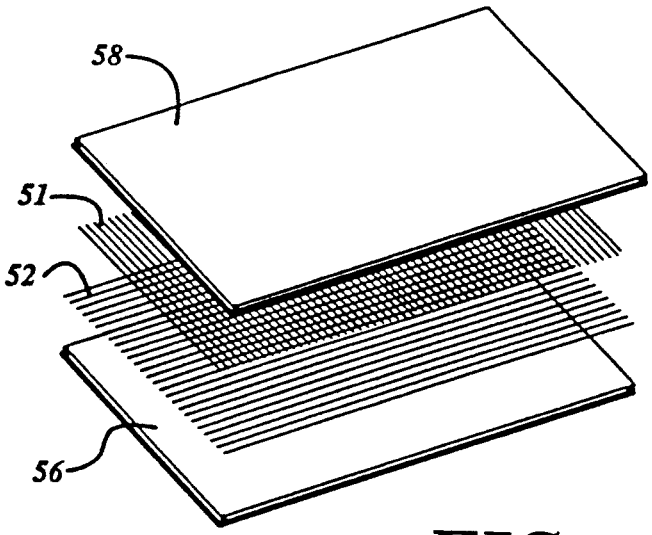
FIG. 5 is a diagrammatic representation of a single ply of the non-woven SPECTRA SHIELD product prior to assembly.

As previously mentioned, an important feature of this invention are the front and back ballistic packages secured within the carrier cover pockets 15 and 34. Such a package or insert 16 is diagrammatically shown in FIG. 4. In FIG. 4, the insert is comprised of three ballistic packages 44, 46 and 48. The packages 44 and 48 are ten plies of woven SPECTRA fiber material such as that shown diagrammatically in FIG. 6. Sandwiched between the packages 44 and 48 is a package comprised of multiple layers of the SPECTRA SHIELD laminas, one layer of which is generally formed as shown on diagrammatically on FIG. 5, namely, a series of SPECTRA fiber fibers 51 laid in a first direction and a second layer of fibers 52 laid cross-ways or at 90° to fibers 51. These fibers are encased in a resin and encapsulated between two polyethylene films 56 and 58 and then compressed. In the embodiment shown, ballistic package 46 includes ten of such plies. Therefore, the FIG. 7 package includes ten plies of SPECTRA SHIELD sandwiched between packages 44 and 48, each of which include ten plies of SPECTRA fiber woven fabric. This arrangement will meet a NIJ threat level II-A.

Figure 8:
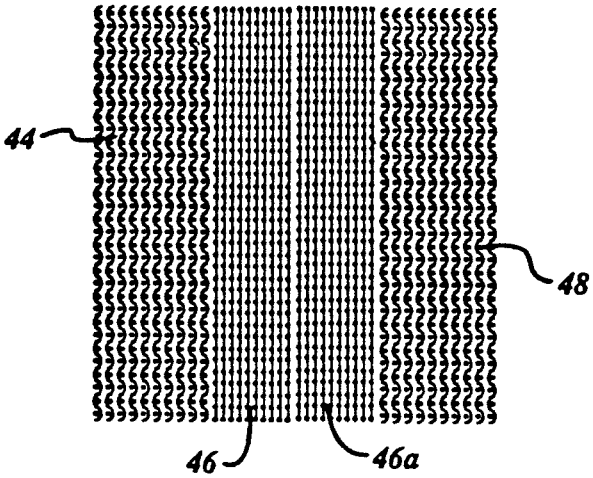
FIG. 8 is a view along the same line as FIG. 7 showing an additional multi-ply SPECTRA Shield insert to meet an increased threat level.
Figure 9:
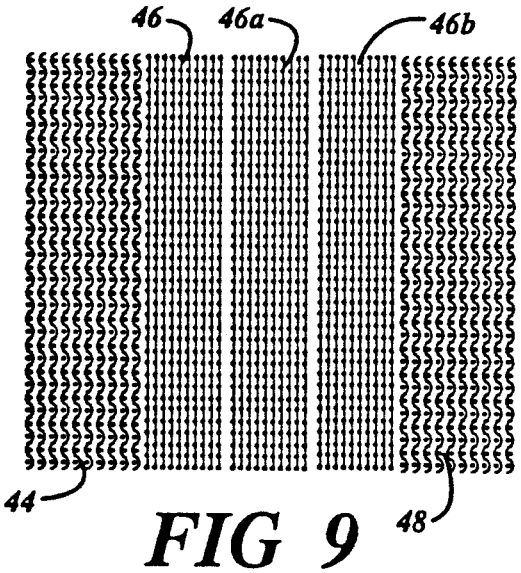
FIG. 9 is a view along the same line as FIG. 7 with an additional multi-ply SPECTRA SHIELD ballistic package insert to meet a greater threat level than that shown in FIG. 8.

If it is desired to meet a NIJ threat level of II, one merely includes a second ten-ply SPECTRA SHIELD package 46a between the SPECTRA fiber woven packages 44 and 48 as shown in FIG. 8. In FIG. 9 there is shown an insert designed to meet the requirements of NIJ threat level IIIA. Note in FIG. 9, that a third ten ply SPECTRA SHIELD package 46b has been added between the SPECTRA fiber woven fabric packages 44 and 48.

Figure 10:
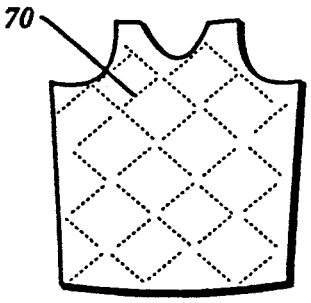
FIG. 10 is a diagrammatic plan view of a ballistic package showing the quilting pattern designed to improve the ballistic performance of the SPECTRA fiber woven fabric panel.

FIG. 10 is a plan view of a ballistic protective package in which the SPECTRA fiber woven plies are secured together in a quilted arrangement as seen at 70. When a bullet strikes a ballistic protective panel, there are tremendous forces that tend to cause a disarray or bunching of fibers which can adversely affect the performance of the ballistic panel when subsequent bullets strike the panel. Quilting reduces this bunching effect and improves the ballistic performance of the woven SPECTRA fiber fabric package against multiple bullet strikes.

Both the SPECTRA SHIELD and the SPECTRA fiber woven fabric have first groups of fibers arranged at 90° with respect to second groups of fibers. In the SPECTRA SHIELD product, the fibers are held in that relationship by a resinous material. The quilting arrangement for the SPECTRA fiber woven fabric is on a 45° bias with respect to the groups of fibers and the quilt is formed with SPECTRA fiber thread to enhance the strength and integrity of the package.

Figure 7:
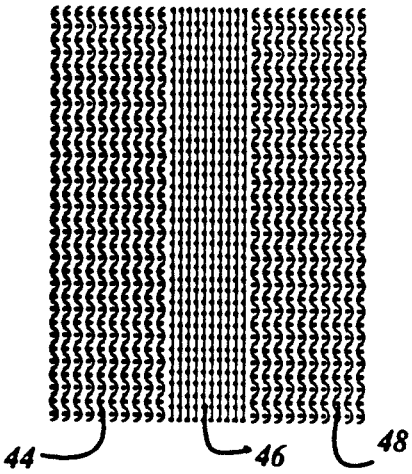
FIG. 7 is a cross section along the line 7—7 of the FIG. 4.

When a ballistic insert or panel is assembled as shown in FIGS. 7, 8 and 9, it is desirable to fasten the SPECTRA fiber woven fabric and SPECTRA SHIELD packages together by stitching with SPECTRA fiber thread so that the user will always be aware of the NIJ threat level for which the vest is designed. The packages of the combined insert are sewn together with SPECTRA fiber thread in a box stitch pattern shown at 72 and the outwardly extending rays 74. It should be noted that the seam lines do not intersect. This prevents the possibility of the needle penetrating the ballistic units twice in the same area. A double penetration in the same area could weaken the package to the extent the package might not meet the NIJ ballistic threat level for which it is designed.

Figure 11:
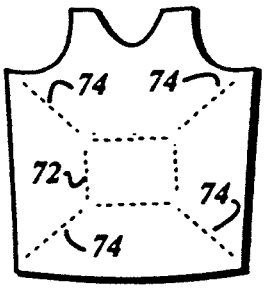
FIG. 11 is a plan view of a ballistic package showing a stitching scheme for the combined woven fabric and SPECTRA SHIELD ballistic panels.

When using a ten-ply thirty-ply ten-ply arrangement shown in FIG. 9, the thirty-ply package of the individual SPECTRA SHIELD sheets are not sewn. This provides increased comfort and flexibility without adversely affecting ballistic performance. When using a ten-ply twenty-ply ten-ply arrangement as shown in FIG. 8, the box stitch shown in FIG. 11 is utilized. The box stitch can also be used with the ten-ten-ten arrangement of FIG. 7. The quilted pattern of FIG. 10 is used with the SPECTRA fiber woven fabric packages.

Figure 13:
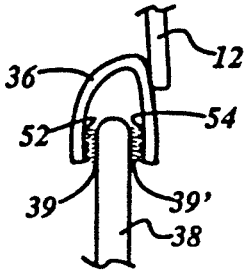
FIG. 13 is a cross-section through a flap retainer.
Figure 12:
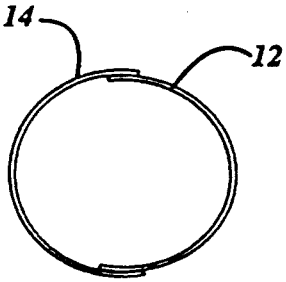
FIG. 12 is a cross-section along the line 12—12 of FIG. 1.

For specified threat situations, the vest is equipped to receive a groin area protector 38 which is secured to the front carrier cover 12 by hook and loop fasteners. See FIG. 13. When not in use, this groin protector 38 is inserted in the pocket 38a of the rear carrier cover 14. When so secured, the vest will provide additional protection to the back area around the lower spine and kidneys. Also, the front carrier 12 is equipped with a pocket 80 that receives a semi-rigid plate 82 of compressed Spectra material. This provides additional protection over the heart, lungs and sternum. As can be seen in FIG. 12, the carrier covers 12 and 14 and their ballistic insert are sufficiently generous in width to permit an overlap.

As can be seen, a variety of ballistic protective devices, using the SPECTRA SHIELD and the Spectra woven fabric in combination with one another can be constructed. This results in a body armor of extraordinary protectiveness, durability and comfort.

The embodiments disclosed are the invention or presently contemplated. However, the reader should understand that various changes and modifications can be made without departing from the spirit of the present invention as described in the claims.

We claim:

1. A ballistic resistant vest comprising:

a front panel having inner and outer layers defining a front containment pocket, a rear panel having inner and outer layers defining a rear containment pocket, a first flexible ballistic protective insert received by said front containment pocket, a second flexible ballistic protective insert received by said rear containment pocket, each of said first and second inserts each compromising:

a first package of woven SPECTRA fabric plies, a second package of woven SPECTRA fabric plies, and a third package of SPECTRA SHIELD plies, and said third package is sandwiched between said first and second packages;

at least three parallel strips of first elements of a hook and loop fastening system secured to said outer layer of said front panel and said strips being generally parallel to the ground when said vest is worn by a user, at least three resilient straps each having first and second ends, first means securing said first ends to said outer layer of said rear panel, second elements of said hook and loop fastening system at said seconds ends, and said straps having lengths sufficiently long and sufficient in strength to overcome the flexibility of said first and second inserts and to permit said second elements to lock with said strips somewhere along their lengths for purposes of adjustably connecting said front and rear panels together, second means for securing said first, second and third packages in close face-to-face relationship with one another, and said plies of said first and second packages individually secured by SPECTRA thread stitching in a quilt pattern along a bias at specific tension with respect to the fabric of said woven plies.

2. The device of claim 1 wherein said front panel has at its lower edge, a grain protector panel, and third means for connecting and disconnecting said groin protector panel to said lower edge of said front panel.

3. The device of claim 1 wherein said rear panel has a second containment pocket, said second containment pocket receiving said groin protector panel when said groin protector is disconnected from said front panel.

4. The device of claim 1 wherein at least one of said ballistic protective inserts includes a fourth package of SPECTRA SHIELD plies located between said first and second packages of SPECTRA woven fabric plies.

5. The device of claim 4 wherein said at least one ballistic protective insert includes a fifth package of other ballistic protective materials located between said first and second packages of SPECTRA woven fabric plies.

6. The device of claim 1 wherein said front panel has at its lower edge, a groin protective panel, and third means for connecting and disconnecting said groin protective panel to said lower edge of said front panel.

* * * * *